US010704397B2

(12) United States Patent
Marsh et al.

(10) Patent No.: US 10,704,397 B2
(45) Date of Patent: Jul. 7, 2020

(54) TURBINE BLADE TRAILING EDGE WITH LOW FLOW FRAMING CHANNEL

(71) Applicant: Siemens Aktiengesellschaft, München (DE)

(72) Inventors: Jan H. Marsh, Orlando, FL (US); Wayne J. McDonald, Charlotte, NC (US); Matthew J. Golsen, Deltona, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 172 days.

(21) Appl. No.: 15/558,285

(22) PCT Filed: Apr. 3, 2015

(86) PCT No.: PCT/US2015/024221
§ 371 (c)(1),
(2) Date: Sep. 14, 2017

(87) PCT Pub. No.: WO2016/160029
PCT Pub. Date: Oct. 6, 2016

(65) Prior Publication Data

US 2018/0058225 A1 Mar. 1, 2018

(51) Int. Cl.
*F01D 5/18* (2006.01)
*B22C 9/10* (2006.01)
(Continued)

(52) U.S. Cl.
CPC ..... *F01D 5/187* (2013.01); *B22C 9/10* (2013.01); *B22D 25/02* (2013.01); *F01D 9/02* (2013.01);
(Continued)

(58) Field of Classification Search
CPC ... F01D 5/12; F01D 5/18; F01D 5/187; F01D 9/02; F05D 2230/21; F05D 2230/211;
(Continued)

(56) References Cited

U.S. PATENT DOCUMENTS 4,153,386 A 5/1979 Leogrande et al.
4,278,400 A 7/1981 Yamarik et al.
(Continued)

FOREIGN PATENT DOCUMENTS

EP 1091092 A2 4/2001
JP 2001107704 A 4/2001
(Continued)

OTHER PUBLICATIONS

PCT International Search Report and Written Opinion dated Nov. 30, 2015 corresponding to PCT Application PCT/US2015/024221 filed Apr. 3, 2015.

*Primary Examiner* — Moshe Wilensky
*Assistant Examiner* — Elton K Wong

(57) ABSTRACT

The present disclosure provides a core structure comprising a trailing edge section including a plurality of rib-forming apertures (126) defined by a plurality of radially-extending channel elements (130) and axially-extending passage elements (128) and a radially outer low flow framing channel element (134) located adjacent to a radially outer edge (124). The core structure may be used for casting a gas turbine engine airfoil (11). The radially outer framing channel element (134) comprises a plurality of notches (14) extending radially inwardly from the radially outer edge (124). A distal portion (144*a*) of the notches (140) overlaps in an axial direction with the rib-forming apertures (126) of a first axially-aligned outer row (138*a*). A radial height of at least one of a first and a second axially-extending passage element (148*a*, 148*b*, 150) is greater than a prevalent radial
(Continued)

height of other axially-extending passage elements (128) in the core structure.

10 Claims, 5 Drawing Sheets

(51) Int. Cl.
*B22D 25/02* (2006.01)
*F01D 9/02* (2006.01)

(52) U.S. Cl.
CPC ..... *F05D 2220/32* (2013.01); *F05D 2230/21* (2013.01); *F05D 2230/211* (2013.01); *F05D 2240/122* (2013.01); *F05D 2240/304* (2013.01); *F05D 2260/20* (2013.01); *F05D 2260/204* (2013.01); *F05D 2260/22141* (2013.01)

(58) Field of Classification Search
CPC ..... F05D 2240/122; F05D 2240/304; F05D 2260/20; F05D 2260/204; F05D 2260/22141; B22C 9/10; B22D 25/02
See application file for complete search history.

(56) References Cited

U.S. PATENT DOCUMENTS 4,474,532 A 10/1984 Pazder
4,589,824 A * 5/1986 Kozlin ..... F01D 5/187 29/889.721
4,753,575 A * 6/1988 Levengood ..... F01D 5/187 415/115
5,002,460 A 3/1991 Lee et al.
5,243,759 A * 9/1993 Brown ..... B22C 9/10 164/122.1
5,246,340 A 9/1993 Winstanley et al.
5,288,207 A 2/1994 Linask
5,599,166 A 2/1997 Deptowicz et al.
5,704,763 A 1/1998 Lee
5,779,447 A 7/1998 Tomita et al.
5,931,638 A 8/1999 Krause et al.
6,106,231 A 8/2000 Brainch et al.
6,179,565 B1 1/2001 Palumbo et al.
6,331,098 B1 12/2001 Lee
6,347,923 B1 2/2002 Semmler et al.
6,402,470 B1 6/2002 Kvasnak et al.
6,481,966 B2 11/2002 Beeck et al.
6,595,750 B2 7/2003 Pameix et al.
6,890,154 B2 5/2005 Cunha
6,896,487 B2 5/2005 Cunha et al.
6,974,308 B2 12/2005 Halfmann et al.
6,981,840 B2 1/2006 Lee et al.
7,097,425 B2 8/2006 Cunha et al.
7,270,515 B2 9/2007 Liang
7,293,962 B2 11/2007 Fried et al.
7,377,748 B2 5/2008 Mongillo et al.
7,478,994 B2 1/2009 Cunha et al.
7,625,178 B2 12/2009 Morris et al.
7,690,894 B1 4/2010 Liang
7,780,414 B1 * 8/2010 Liang ..... B22C 9/10 164/369
7,780,415 B2 8/2010 Liang
7,824,156 B2 11/2010 Dellmann et al.
7,862,299 B1 1/2011 Liang
7,934,906 B2 5/2011 Gu et al.
8,096,768 B1 1/2012 Liang
8,192,146 B2 6/2012 Liang
8,261,810 B1 9/2012 Liang
8,840,363 B2 9/2014 Lee
2005/0053459 A1 3/2005 Cunha et al.
2006/0093480 A1 5/2006 Cunha et al.
2006/0239819 A1 10/2006 Albert et al.
2007/0041835 A1 2/2007 Charbonneau et al.
2012/0269647 A1 10/2012 Vitt et al.
2012/0269649 A1 10/2012 Rawlings et al.
2013/0084191 A1 4/2013 Jiang
2014/0044555 A1 2/2014 Lewis et al.
2016/0169016 A1 * 6/2016 Blaney ..... F01D 9/065 415/115

FOREIGN PATENT DOCUMENTS

JP 2004308659 A 11/2004
WO 2013180792 A2 12/2013

* cited by examiner

TURBINE BLADE TRAILING EDGE WITH LOW FLOW FRAMING CHANNEL

FIELD OF THE INVENTION

The present invention relates to a cooling system for use in an airfoil of a turbine engine, and more particularly, to a trailing edge cooling circuit and core used for forming the same.

BACKGROUND OF THE INVENTION

In a gas turbine engine, compressed air discharged from a compressor section is mixed with fuel and burned in a combustion section, creating combustion products comprising hot combustion gases. The combustion gases are directed through a hot gas path in a turbine section comprising a series of turbine stages typically including a plurality of paired rows of stationary vanes and rotating turbine blades. The turbine blades extract energy from the combustion gases and provide rotation of a turbine rotor for powering the compressor and providing output power.

The airfoils of the vanes and blades are typically exposed to high operating temperatures, and thus include cooling circuits to remove heat from the airfoil and to prolong the life of the vane and blade components. A portion of the compressed air discharged from the compressor section may be diverted to these cooling circuits. Manufacture of airfoils with one or more cooling circuits typically requires the use of a ceramic core comprising framing channels at the radially inner and outer portions in order to provide sufficient structural stability and to prevent unzipping of the ceramic core during casting.

SUMMARY OF THE INVENTION

In accordance with an aspect of the present invention, a core structure for casting a gas turbine engine airfoil is provided. The core structure comprises a trailing edge section for defining a trailing edge of the gas turbine engine airfoil, with at least a portion of the trailing edge section comprising a plurality of rib-forming apertures defined by a plurality of radially-extending channel elements and axially-extending passage elements and a radially outer low flow framing channel element located adjacent to a radially outer edge of the trailing edge section. The rib-forming apertures are arranged in radially-aligned columns, and the rib-forming apertures of alternating radially-aligned columns form axially-aligned rows. The radially outer low flow framing channel element comprises a plurality of notches extending radially inwardly from the radially outer edge. The rib-forming apertures comprising a first axially-aligned outer row are elongated in a radial direction such that a distal portion of the notches overlaps in an axial direction with the rib-forming apertures comprising the first axially-aligned outer row, in which an axial direction is defined between a leading edge and a trailing edge of the airfoil. The notches are radially aligned with the rib-forming apertures of a second axially-aligned outer row. A radial height of a first and/or a second axially-extending passage element is greater than a prevalent radial height of the other axially-extending passage elements within the core structure.

In some aspects of the core structure, the rib-forming apertures comprising a third axially-aligned outer row may be elongated in a radial direction such that the rib-forming apertures comprising the second axially-aligned outer row overlap in an axial direction with the rib-forming apertures comprising the third axially-aligned outer row. In other aspects, the radial height $H_1$ of the first axially-extending passage elements may be greater than or equal to the radial height $H_2$ of the second axially-extending passage elements, and $H_2$ may be greater than or equal to the prevalent radial height H. In additional aspects, a portion of the radially outer edge between the notches may comprise a substantially planar area.

In a further aspect of the core structure, the trailing edge section may further comprise a radially inner low flow framing channel element located adjacent to a radially inner edge of the trailing edge section. The radially inner low flow framing channel element may comprise a plurality of notches extending radially outwardly from the radially inner edge. A first axially-aligned inner row of the rib-forming apertures may be elongated in a radial direction such that a distal portion of the notches overlaps in an axial direction with the rib-forming apertures comprising the first axially-aligned inner row. The notches of the radially inner low flow framing channel may be radially aligned with the rib-forming apertures of a second axially-aligned inner row of the rib-forming apertures. In a particular aspect, a portion of the radially inner edge between the notches may comprise a substantially planar area.

In accordance with another aspect of the invention, a core structure for forming a cooling configuration in a gas turbine engine airfoil is provided. The gas turbine engine airfoil comprises an outer wall defining a leading edge, a trailing edge, a pressure side, a suction side, a radially outer tip, and a radially inner end. The core structure comprises a trailing edge section defining the trailing edge of the gas turbine engine airfoil. The trailing edge section comprises a plurality of rib-forming apertures defined by a plurality of radially-extending channel elements and axially-extending passage elements, a radially outer low flow framing channel element located adjacent to a radially outer edge of the trailing edge section, and a radially inner low flow framing channel element located adjacent to a radially inner edge of the trailing edge section. The rib-forming apertures are arranged in radially-aligned columns, with the rib-forming apertures of alternating radially-aligned columns forming axially-aligned rows.

The radially outer low flow framing channel element comprises a plurality of notches extending radially inwardly from the radially outer edge. The rib-forming apertures comprising a first axially-aligned outer row are elongated in a radial direction such that a distal portion of the notches overlaps in an axial direction with the rib-forming apertures comprising the first axially-aligned outer row, in which an axial direction is defined between the leading edge and the trailing edge of the airfoil. The rib-forming apertures comprising a third axially-aligned outer row are elongated in a radial direction such that the rib-forming apertures comprising a second axially-aligned outer row overlap in an axial direction with the rib-forming apertures comprising the third axially-aligned outer row. The notches are radially aligned with the rib-forming apertures of the second axially-aligned outer row. A radial height of at least one of a first axially-extending passage element and a second axially-extending passage element is greater than a prevalent radial height of axially-extending passage elements within the core structure.

The radially inner low flow framing channel element comprises a plurality of notches extending radially outwardly from the radially inner edge. The rib-forming apertures comprising a first axially-aligned inner row are elongated in a radial direction such that a distal portion of the notches overlaps in an axial direction with the rib-forming apertures comprising the first axially-aligned inner row. The rib-forming apertures comprising a third axially-aligned inner row are elongated in a radial direction such that the rib-forming apertures comprising the second axially-aligned inner row overlap in an axial direction with the rib-forming apertures comprising the third axially-aligned inner row. The notches of the radially inner low flow framing channel element are radially aligned with the rib-forming apertures of the second axially-aligned inner row.

In a particular aspect of the core structure, a portion of each of the radially outer edge and the radially inner edge between the notches comprises a substantially planar area. In a further particular aspect, the radial height $H_1$ of the first axially-extending passage elements is greater than or equal to the radial height $H_2$ of the second axially-extending passage elements, and wherein $H_2$ is greater than or equal to the prevalent radial height H.

In accordance with a further aspect of the invention, an airfoil in a gas turbine engine is provided. The airfoil comprises an outer wall defining a leading edge, a trailing edge, a pressure side, a suction side, a radially inner end, and a radially outer tip comprising a tip cap. An axial direction is defined between the leading edge and the trailing edge. The airfoil further comprises a trailing edge cooling circuit defined in a portion of the outer wall adjacent to the trailing edge and receiving cooling fluid for cooling the outer wall. The trailing edge cooling circuit comprises a plurality of axially-extending passages and a plurality of radially-extending channels defined by a plurality of rib structures and a radially outer low flow framing channel located adjacent to the tip cap. The rib structures are arranged in radially-aligned columns that are substantially transverse to a flow axis of the cooling fluid, with the rib structures of alternating radially-aligned columns forming axially-aligned rows. The radially outer low flow framing channel comprises a plurality of protrusions extending radially inwardly from the tip cap. The rib structures comprising a first axially-aligned outer row are elongated in a radial direction such that a distal portion of the protrusions overlaps in an axial direction with the rib structures comprising the first axially-aligned outer row. The protrusions are radially aligned with the rib structures of a second axially-aligned row, and the protrusions are substantially transverse to a flow axis of the cooling fluid.

In one aspect of the airfoil, the rib structures comprising a third axially-aligned outer row are elongated in a radial direction such that the rib structures comprising the second axially-aligned outer row overlap in an axial direction with the rib structures comprising the third axially-aligned outer row. In another aspect, a radial height of a first and/or a second axially-extending passage is greater than a prevalent radial height of the axially-extending passages in the trailing edge cooling circuit. In some aspects, the plurality of rib structures and the plurality of protrusions define a flowpath in the axial direction through the radially outer low flow framing channel that requires the cooling fluid to make a plurality of substantially 90 degree turns.

In further aspects of the airfoil, the trailing edge cooling circuit further comprises a radially inner low flow framing channel located adjacent to the radially inner end and comprising a plurality of protrusions extending radially outwardly from the radially inner edge. The rib structures comprising a first axially-aligned inner row are elongated in a radial direction such that a distal portion of the protrusions overlaps in an axial direction with the rib structures comprising the first axially-aligned inner row. The rib structures comprising a third axially-aligned inner row are elongated in a radial direction such that the rib structures comprising a second axially-aligned inner row overlap in an axial direction with the rib structures comprising the third axially-aligned inner row. The protrusions of the radially inner low flow framing channel are radially aligned with the rib structures comprising the second axially-aligned inner row and are substantially transverse to the flow axis of the cooling fluid. In a particular aspect, the plurality of rib structures and the plurality of protrusions define a flowpath in the axial direction through the radially inner low flow framing channel that requires the cooling fluid to make a plurality of substantially 90 degree turns.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
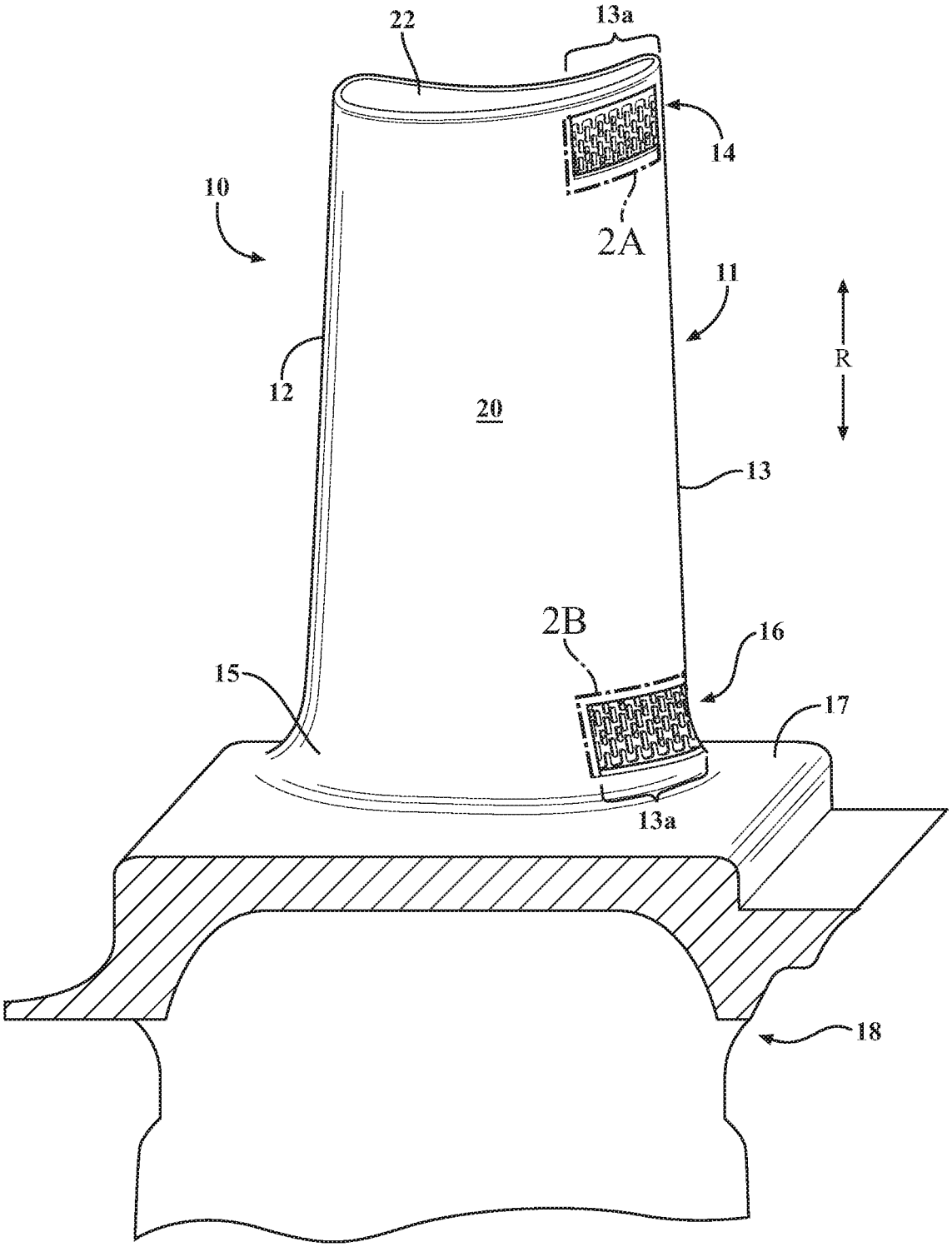
FIG. 1 is a perspective view of an airfoil assembly according to the present invention in which a portion of the outer wall is cut away to illustrate aspects of the invention in detail.

The present invention provides a construction for an airfoil located within a turbine section of a gas turbine engine (not shown). Referring now to FIG. 1, an exemplary airfoil assembly 10 constructed in accordance with an aspect of the present invention is illustrated. The airfoil assembly 10 includes an airfoil 11, a platform 17, and a root 18 that is used to conventionally secure the airfoil assembly 10 to a shaft and disc assembly of the turbine section (not shown) for supporting the airfoil assembly 10 in the gas flow path of the turbine section. Although aspects of the invention are discussed herein with specific reference to components of a blade assembly in a gas turbine engine, those skilled in the art will understand that the concepts disclosed herein could also be used in the formation of a stationary vane assembly.

The airfoil 11 shown in FIG. 1 includes an outer wall defining a leading edge 12, a trailing edge 13, a suction side 20, a pressure side (not labeled) opposite the suction side 20, a radially inner end 15 adjacent to the platform 17, and a radially outer tip 22. As used throughout, unless otherwise noted, the terms "radial," "radially inner," "radially outer," and derivatives thereof are used with reference to a radial direction as represented by arrow R in FIG. 1, which is parallel to a longitudinal axis of the airfoil 11. The terms "axial," "upstream," "downstream," and derivatives thereof are used with reference to a flow of combustion gases through the hot gas path in the turbine section, and an "axial direction" is defined between the leading and trailing edges 12, 13 of the airfoil 11. The airfoil 11 extends in a radial direction R from the radially inner end 15 to the radially outer tip 22.

In FIG. 1, a portion of the suction side 20 of the airfoil 11 is cut away at the radially inner end 15 and the radially outer tip 22 to illustrate a portion 13*a* of the internal structure of the trailing edge 13, which may comprise one or more trailing edge cooling circuits, such as radially outer and radially inner trailing edge cooling circuits 14, 16, that are each defined in a cavity located within a portion of the outer wall of the airfoil 11 adjacent to the trailing edge 13. An enlarged portion of the radially outer and radially inner trailing edge cooling circuits 14, 16 (also referred to herein as the radially outer and radially inner cooling circuits 14, 16) from FIG. 1 is shown in detail in FIGS. 2A and 2B. As the radially inner cooling circuit 16 is substantially similar in structure to, and may generally comprise a mirror image of, the radially outer cooling circuit 14, some aspects of the invention are described in detail only with reference to the radially outer cooling circuit 14.

Figure 2A:
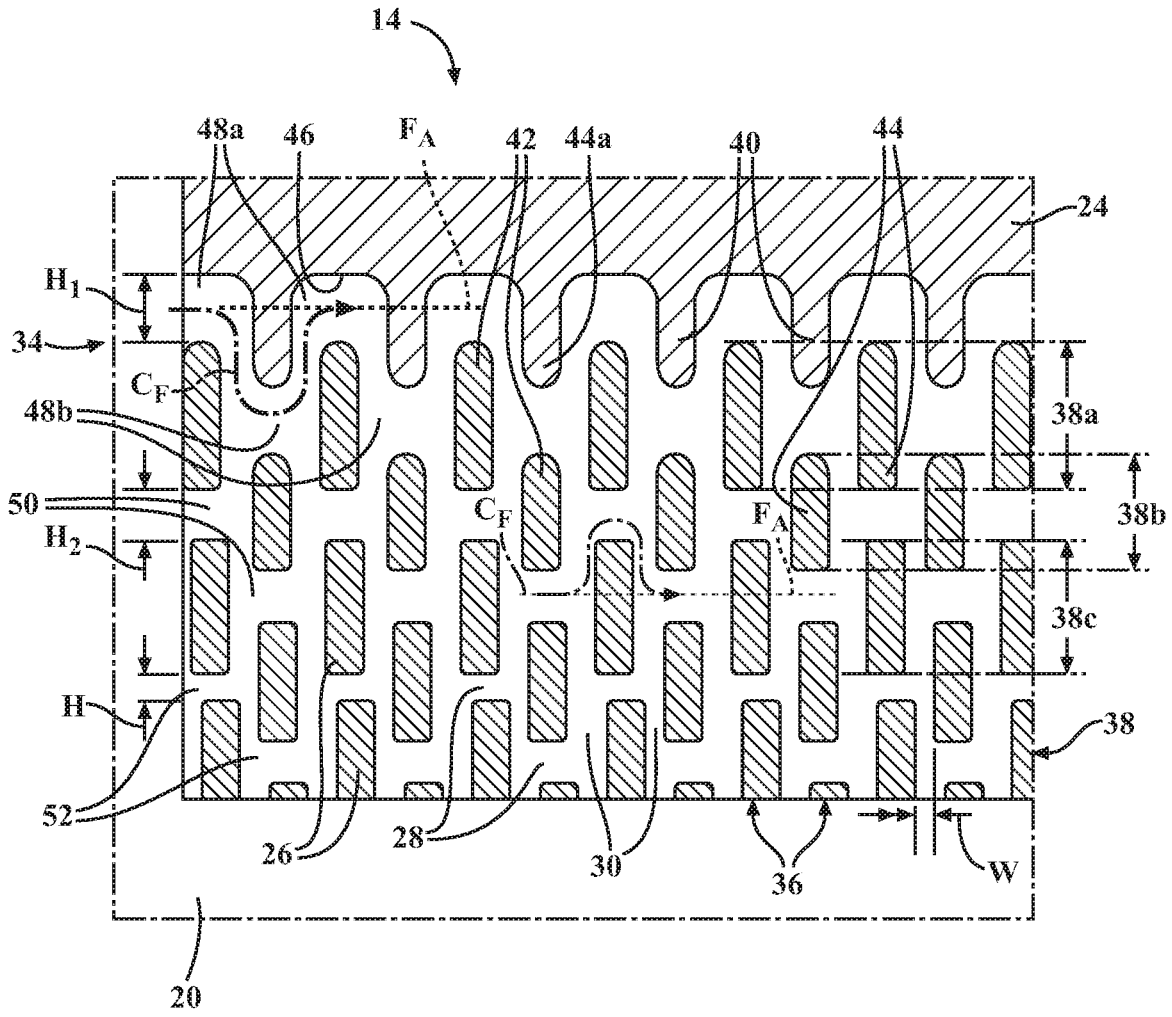
FIGS. 2A and 2B are enlarged side views of the sections indicated by boxes 2A and 2B, respectively, in FIG. 1.
Figure 2B:
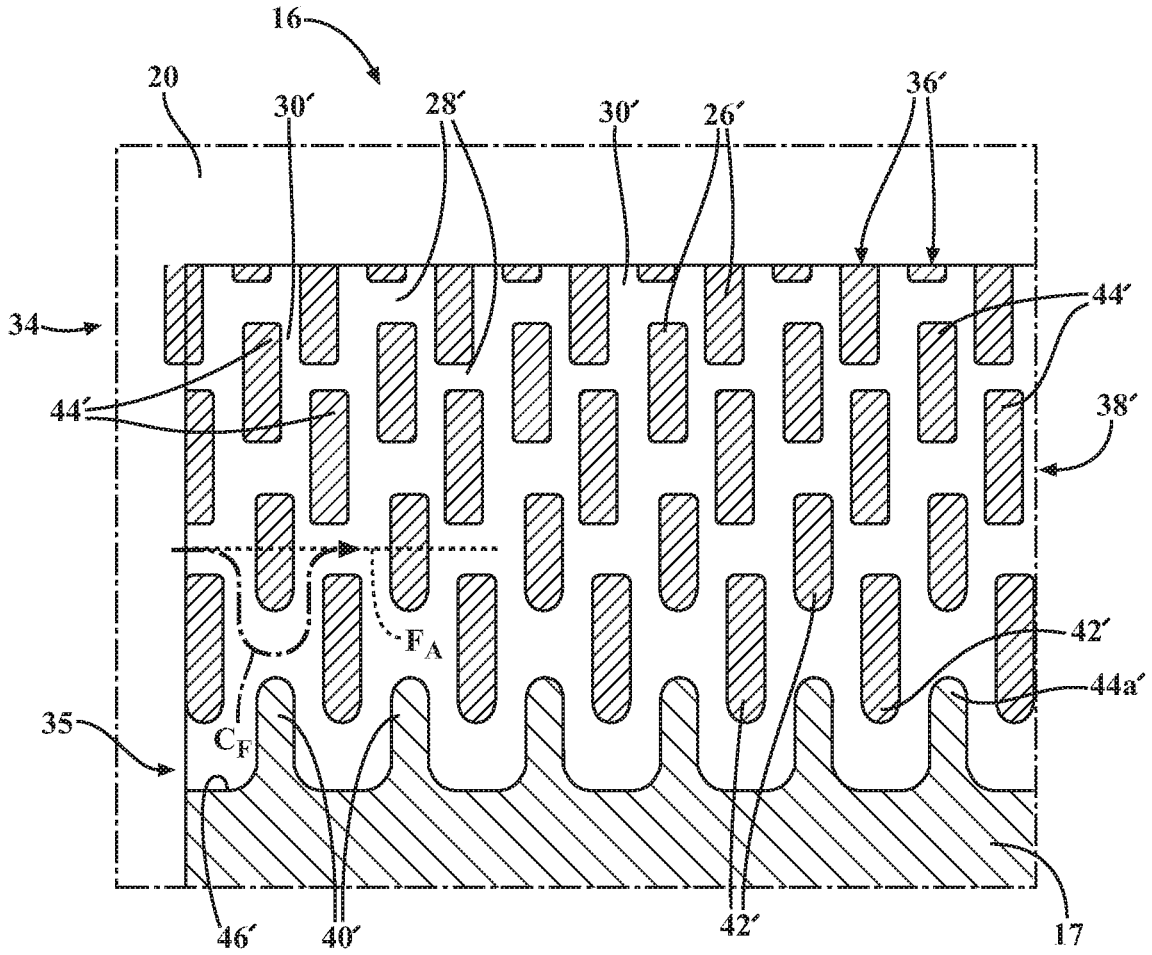

With reference to FIGS. 1, 2A, and 2B, a radially outer edge of the radially outer cooling circuit 14 is adjacent to and may be defined by the radially outer tip 22, which further comprises a tip cap 24. The radially inner cooling circuit 16 is adjacent to the radially inner end 15 of the airfoil 11, and a radially inner edge of the radially inner cooling circuit 16 may be defined, for example, by the platform 17, as shown in FIG. 2B, or by the root 18 (not shown). The radially outer and radially inner cooling circuits 14, 16 may each comprise a plurality of axially-extending passages 28, 28' and a plurality of radially-extending channels 30, 30' that are defined by a plurality of rib structures 26, 26'. The rib structures 26, 26' may comprise any suitable geometry, and as shown in FIGS. 2A and 2B, the rib structures 26, 26' may comprise generally rectangular structures. The rib structures 26, 26' may be arranged into a plurality of substantially radially-aligned columns 36, 36', which are also referred to herein as ribs, and the rib structures 26, 26' of alternating radially-aligned columns 36, 36' form axially-aligned rows 38, 38'.

Cooling fluid $C_F$ is indicated in FIGS. 2A and 2B by arrows entering the radially outer and inner cooling circuits 14, 16 on the left-hand or upstream side via the axially-extending passages 28, 28'. The cooling fluid $C_F$ may be received, for example, from a mid-chord cooling circuit (not shown) immediately upstream of the cooling fluid $C_F$, which may be conventionally supplied with compressed air from the root 18 (see FIG. 1). The rib structures 26, 26' are radially offset relative to one another and to adjacent upstream and downstream axially-extending passages 28, 28'. With the exception of the rib structures 26, 26' forming a first axially-aligned row 38*a* (not labeled in FIG. 2B), a portion of each rib structure 26, 26' overlaps, in an axial direction, with a portion of the rib structures 26, 26' in adjacent, radially-aligned columns 36, 36'. For example, a distal portion 44, 44' of each rib structure 26, 26', which is defined as the portion of each rib structure 26, 26' that is furthest away from the radially outer and inner edge of the radially outer and inner cooling circuits 14, 16, respectively, overlaps, in an axial direction, with a proximal portion 42, 42' of each rib structure 26, 26', which is defined as the portion of each rib structure 26, 26' that is closest to the radially outer and inner edge.

In addition, the rib structures 26, 26' may be substantially transverse to a flow axis $F_A$ of the cooling fluid $C_F$ exiting the axially-extending passages 28, 28' such that the cooling fluid $C_F$ impinges the rib structures 26, 26' in the radially-aligned column 36, 36' of rib structures 26, 26' immediately downstream of each axially-extending passage 28, 28'. For example, as shown in FIGS. 2A and 2B, an axially-extending line parallel to the flow axis $F_A$ intersects the proximal portions 42, 42' and the distal portions 44, 44' of alternating rows of rib structures 26, 26'. After impinging the rib structures 26, 26', the cooling fluid $C_F$ is then forced to flow in a transverse direction, i.e. the cooling fluid $C_F$ is forced to make a substantially 90 degree turn, within the radially-extending channel 30, 30' before changing direction again to flow in a transverse direction to enter a downstream, axially-extending passage 28, 28'. The rib structures 26, 26' thus define a tortuous flowpath such that the cooling fluid $C_F$ continues to flow, in alternating, transverse directions, through the radially-extending channels 30, 30' and axially-extending passages 28, 28' of the radially outer and inner cooling circuits 14, 16 toward the trailing edge 13 of the airfoil 11 (see FIG. 1).

With continued reference to FIGS. 2A and 2B, the radially outer cooling circuit 14 comprises a radially outer low flow framing channel 34 that is located adjacent to the tip cap 24, and the radially inner cooling circuit 16 comprises a radially inner low flow framing channel 35 that is located adjacent to the radially inner edge as defined by the platform 17. The radially outer and radially inner low flow framing channels 34, 35 each comprise a plurality of protrusions 40, 40', with the protrusions 40 of the radially outer low flow framing channel 34 extending radially inwardly from a radially inner surface of the tip cap 24 and the protrusions 40' of the radially inner low flow framing channel 35 extending radially outwardly from a radially inner surface of the platform 17. At least a portion of the tip cap 24 located between the protrusions 40, and defining the radially outer edge of the radially outer low flow framing channel 34, may comprise a substantially planar area 46. At least a portion of the platform 17 located between the protrusions 40', and defining the radially inner edge of the radially inner low flow framing channel 35, may comprise a substantially planar area 46'.

With specific reference to the radially outer cooling circuit 14 shown in FIG. 2A, the rib structures 26 comprising the first axially-aligned outer row 38*a* may be elongated in a radial direction such that a distal portion 44*a* of the protrusions 40 overlaps, in an axial direction, with the proximal portion 42 of the rib structures 26 comprising the first axially-aligned outer row 38*a*. The protrusions 40 are substantially radially aligned with the rib structures 26 comprising a second axially-aligned outer row 38*b*. The rib structures 26 comprising the third axially-aligned outer row 38*c* may also be elongated in a radial direction such that a distal portion 44 of the rib structures 26 comprising the second axially-aligned outer row 38*b* overlaps, in an axial direction, with a proximal portion 42 of the rib structures 26 comprising the third axially-aligned outer row 38*c*.

Although some corresponding elements of the radially inner low flow framing channel 35 are not labeled in FIG. 2B, those of skill in the art will understand that the features of the invention as described herein may apply equally to the structure of the radially inner low flow framing channel 35. For example, the rib structures 26' comprising a first axially-aligned inner row are elongated in a radial direction such that a distal portion 44*a*' of the protrusions 40' overlaps, in an axial direction, with a proximal portion 42' of the rib structures 26' of the first axially-aligned inner row. Also similar to the structure of the radially outer low flow framing channel 34, the protrusions 40' of the radially inner low flow framing channel 35 are radially aligned with the rib structures 26' of a second axially-aligned inner row. The rib structures 26' of a third axially-aligned inner row may be elongated in a radial direction such that a proximal portion 42' of the rib structures 26' of the third axially-aligned inner row overlaps, in an axial direction, with a distal portion 44' of the rib structures 26' of the second axially-aligned inner row.

As shown in FIGS. 2A and 2B, the protrusions 40, 40' of the radially outer and inner cooling circuits 14, 16 are substantially transverse to the flow axis $F_A$ of the cooling fluid $C_F$ exiting the axially-extending passages 28, 28' and passing through the radially outer and radially inner low flow framing channels 34, 35. That is, an axially extending line parallel to the flow axis $F_A$ intersects the distal portions 44*a*, 44*a*' of the protrusions 40, 40' and the proximal portions 42, 42' of the rib structures 26 comprising the first axially-aligned row 38*a* (not labeled in FIG. 2B). The plurality of rib structures 26, 26' and the plurality of protrusions 40, 40' thus define a flowpath in the axial direction through the radially outer and inner low flow framing channels 34, 35 that requires the cooling fluid $C_F$ to make a plurality of substantially 90 degree turns as the cooling fluid $C_F$ flows through the radially outer and inner low flow framing channels 34, 35 toward the trailing edge 13 of the airfoil 11 (see FIG. 1).

For example, as shown with reference to the radially outer cooling circuit 14 in FIG. 2A, the cooling fluid $C_F$ as indicated by arrows enters a portion of the radially outer low flow framing channel 34 comprising a first axially-extending passage 48*a* defined between the planar area 46 of the tip cap 24 and the rib structures 26 of the first axially-aligned outer row 38*a* and impinges one of the plurality of protrusions 40. Similar to the flow of the cooling fluid $C_F$ through the axially-extending passages 28 and the radially-extending 30, the cooling fluid $C_F$ is then forced to flow in a transverse direction, i.e. to make a substantially 90 degree turn, within the adjacent radially-extending channel 30, before changing direction again to flow in a transverse direction to enter, for example, a first axially-extending passage 48*b* defined between the protrusion 40 and the rib structures 26 of the second axially-aligned outer row 38*b*. The cooling fluid $C_F$ then continues to flow through the radially outer low flow framing channel 34 in alternating, transverse directions toward the trailing edge 13 of the airfoil 11 (see FIG. 1).

As shown in FIGS. 2A and 2B, a full round may be applied to the respective distal portions 44*a*, 44*a*' of the protrusions 40, 40' in the radially outer and radially inner low flow framing channels 34, 35. In addition, full rounds may be applied to the respective proximal portions 42, 42' of the rib structures 26, 26' comprising the first and second outer and inner axially-aligned rows 38*a*, 38*b* of the radially outer and inner low flow framing channels 34, 35. The rounded edges prevent crack initiation that might otherwise occur at the sharper corners of the remaining, rectangular-shaped rib structures 26, 26' as shown in FIGS. 2A and 2B.

The present invention further includes a core, also referred to herein as a core structure, for casting and forming at least a portion of an airfoil assembly 10 as described herein and as shown, for example, in FIGS. 1, 2A, and 2B. With reference to FIG. 1, the core structure may be used, for example, to cast a gas turbine engine airfoil 11 comprising an outer wall defining a leading edge 12, a trailing edge 13, a suction side 20, a pressure side (not labeled) opposite the suction side, a radially outer tip 22, and a radially inner end 15. The core structure may comprise, for example, a ceramic core. The core structure may also be used for casting and forming at least a portion of a cooling configuration within the airfoil assembly 10. In accordance with one aspect of the present invention, the core structure may be used to define the portion 13*a* of the internal structure of the airfoil 11 adjacent to the trailing edge 13, which may be referred to herein as a trailing edge section and may include one or both of the radially outer and radially inner cooling circuits 14, 16, as shown in FIGS. 1, 2A, and 2B.

Figure 3:
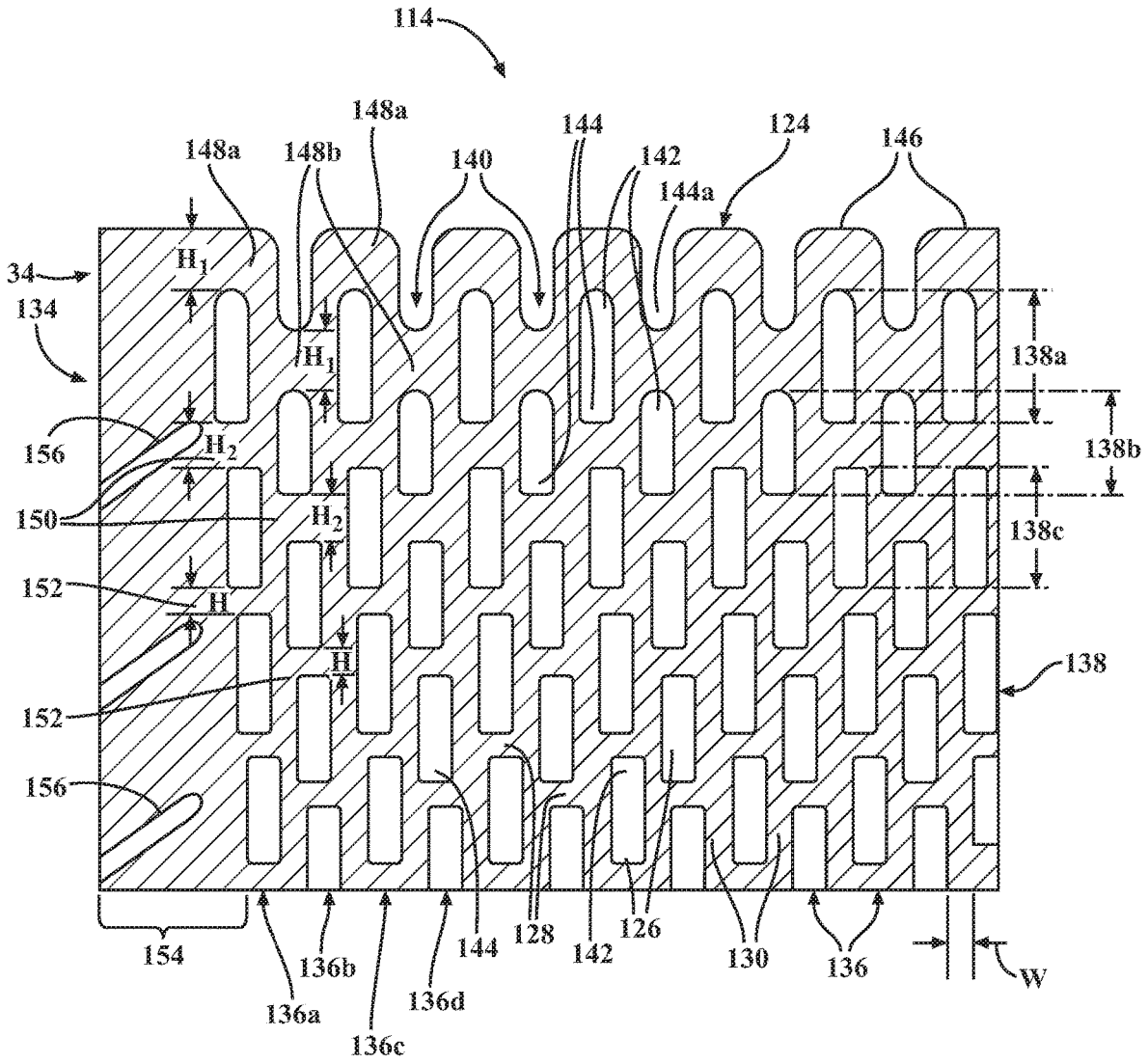
FIG. 3 is an enlarged view similar to the section shown in FIG. 2A illustrating a core structure used to manufacture an airfoil according to the present invention.

The portion of the core structure depicted in FIG. 3 may be used to define the radially outer trailing edge cooling circuit 14 as described herein and comprises a view similar to the portion of the radially outer cooling circuit 14 depicted in FIG. 2A. As the core structure to define the radially inner cooling circuit 16 is substantially similar to the core structure to define the radially outer cooling circuit 14, some aspects of the invention are described in detail only with reference to the radially outer cooling circuit 14 and the core structure used for forming the same. Elements of the core structure in FIG. 3 with corresponding structures in the airfoil 11 and the radially outer cooling circuit 14 shown in FIGS. 1 and 2A are given corresponding reference numbers with 100 added.

As shown in FIG. 3, the core structure comprises a radially outer cooling circuit section 114, which may comprise a plurality of rib-forming apertures 126 defined by a plurality of radially-extending channel elements 130 and axially-extending passage elements 128. The rib-forming apertures 126 may comprise any suitable geometry, and in the embodiment shown, the rib-forming apertures 126 comprise a generally rectangular shape. The rib-forming apertures 126 are arranged in substantially radially-aligned columns 136, with the rib-forming apertures 126 of alternating radially-aligned columns 136 forming axially-aligned rows 138. With the exception of the rib-forming apertures 126 comprising a first axially-aligned row 138*a*, the rib-forming apertures 126 are radially offset relative to each other and to adjacent upstream and downstream axially-extending passage elements 128 such that a proximal portion 142 of each rib-forming aperture 126, which is defined as the portion of each rib-forming aperture 126 closest to a radially outer edge 124, overlaps, in an axial direction, with a distal portion 144 of the rib-forming apertures 126 in adjacent, radially-aligned columns 136, in which the distal portion of each rib-forming aperture 126 is defined as the portion furthest away from the radially outer edge 124.

The radially outer cooling circuit section 114 further comprises a radially outer low flow framing channel element 134 located adjacent to the radially outer edge 124, which may correspond to the tip cap 24 (see FIG. 2A). As shown in FIG. 3, the radially outer framing channel element 134 comprises a plurality of notches 140 extending radially inwardly from the radially outer edge 124. At least a portion of the radially outer edge 124 between the notches 140 may comprise a substantially planar area 146. The rib-forming apertures 126 comprising the first axially-aligned outer row 138*a* may be elongated in a radial direction such that a distal portion 144*a* of the notches 140 overlaps, in an axial direction, with a proximal portion 142 of the rib-forming apertures 126 of the first axially-aligned outer row 138*a*. In addition, the notches 140 are radially aligned with the rib-forming apertures 126 of a second axially-aligned outer row 138*b*. The rib-forming apertures 126 comprising a third axially-aligned outer row 138*c* may also be elongated in a radial direction such that a distal portion 144 of the rib-forming apertures 126 of the second axially-aligned outer row 138*b* overlaps, in an axial direction, with a proximal portion 142 of the rib-forming apertures 126 comprising the third axially-aligned outer row 138*c*.

As previously noted with respect to the radially outer and inner low flow framing channels 34, 35 in FIGS. 2A and 2B, a full round may be applied to the distal portion 144*a* of the notches 140 in the radially outer low flow framing channel element 134, as shown in FIG. 3. In addition, full rounds may be applied to the proximal portions 142 of the rib-forming apertures 126 comprising the first and second axially-aligned outer rows 138*a*, 138*b*. In some aspects of the invention, an axial width W of the plurality of radially-extending channel elements 130 may be substantially uniform along a radial extent of the radially extending channel elements 130.

In another aspect of the invention, the core structure may further include a radially inner cooling circuit section (not shown) to define, for example, the radially inner cooling circuit 16, as shown in FIGS. 1 and 2B. The radially inner cooling circuit section may generally comprise a mirror image of the radially outer cooling circuit section 114. Specifically, the radially inner cooling circuit section may comprise a plurality of rib-forming apertures defined by a plurality of radially-extending channel elements and axially-extending passage elements. The rib-forming apertures may be arranged in substantially radially-aligned columns, and the rib-forming apertures of alternating radially-aligned columns form axially-aligned rows, in which the rib-forming apertures are radially offset relative to one another and to adjacent upstream and downstream axially-extending passage elements. A proximal portion of each rib-forming aperture overlaps, in an axial direction, with a distal portion of the rib-forming apertures in adjacent, radially-aligned columns.

The radially inner cooling circuit section may further comprise a radially inner low flow framing channel element located adjacent to a radially inner edge of the core structure, which may define a portion of, for example, the platform 17 or root 18 of the airfoil 11 (see FIGS. 1 and 2B). The radially inner framing channel element may comprise a plurality of notches extending radially outwardly from the radially inner edge, with a portion of the radially inner edge between the notches comprising a substantially planar area. The rib-forming apertures of a first axially-aligned inner row are elongated in a radial direction such that a distal portion of the notches overlaps, in an axial direction, with a proximal portion of the rib-forming apertures comprising the first axially-aligned inner row. The notches are radially aligned with the rib-forming apertures of a second axially-aligned inner row. The rib-forming apertures comprising a third axially-aligned inner row may also be elongated in a radial direction such that a distal portion of the rib-forming apertures comprising the second axially-aligned inner row overlaps, in an axial direction, with a proximal portion of the rib-forming apertures comprising the third axially-aligned inner row. Full rounds may be applied to corresponding structures in the radially inner low flow framing channel element.

It is further noted that the core structure for casting and forming a cooling configuration within an airfoil assembly 10 and an airfoil 11 as shown in FIG. 1 and as described herein may further include one or more additional core sections (not shown) that define the leading edge 12, the suction side 20, and/or the pressure side (not shown) of the airfoil 11, as well as additional portions of the trailing edge 13, the radially outer tip 22, and/or the radially inner end 15 of the airfoil 11 and portions of the platform 17 and root 18 of the airfoil assembly 10. The core structure may also define one or more conventional, internal cooling circuits within the airfoil 11. For example, the core structure may further comprise a section for defining a mid-chord cooling circuit, which is partially illustrated in FIG. 3 as a mid-chord section 154, with a first radially-aligned column 136*a* of rib-forming structures 126 forming rib structures (not shown) in the airfoil 11 that define an entrance into the radially outer cooling circuit 14. In addition, the core structure may further define one or more cooling enhancement structures, such as turbulating features, e.g., trip strips 156, bumps, dimples, etc., which form corresponding cooling features (not shown) in the airfoil 11 to enhance cooling effected by the cooling fluid $C_F$ flowing through the airfoil assembly 10 and the airfoil 11 during operation.

Figure 4:
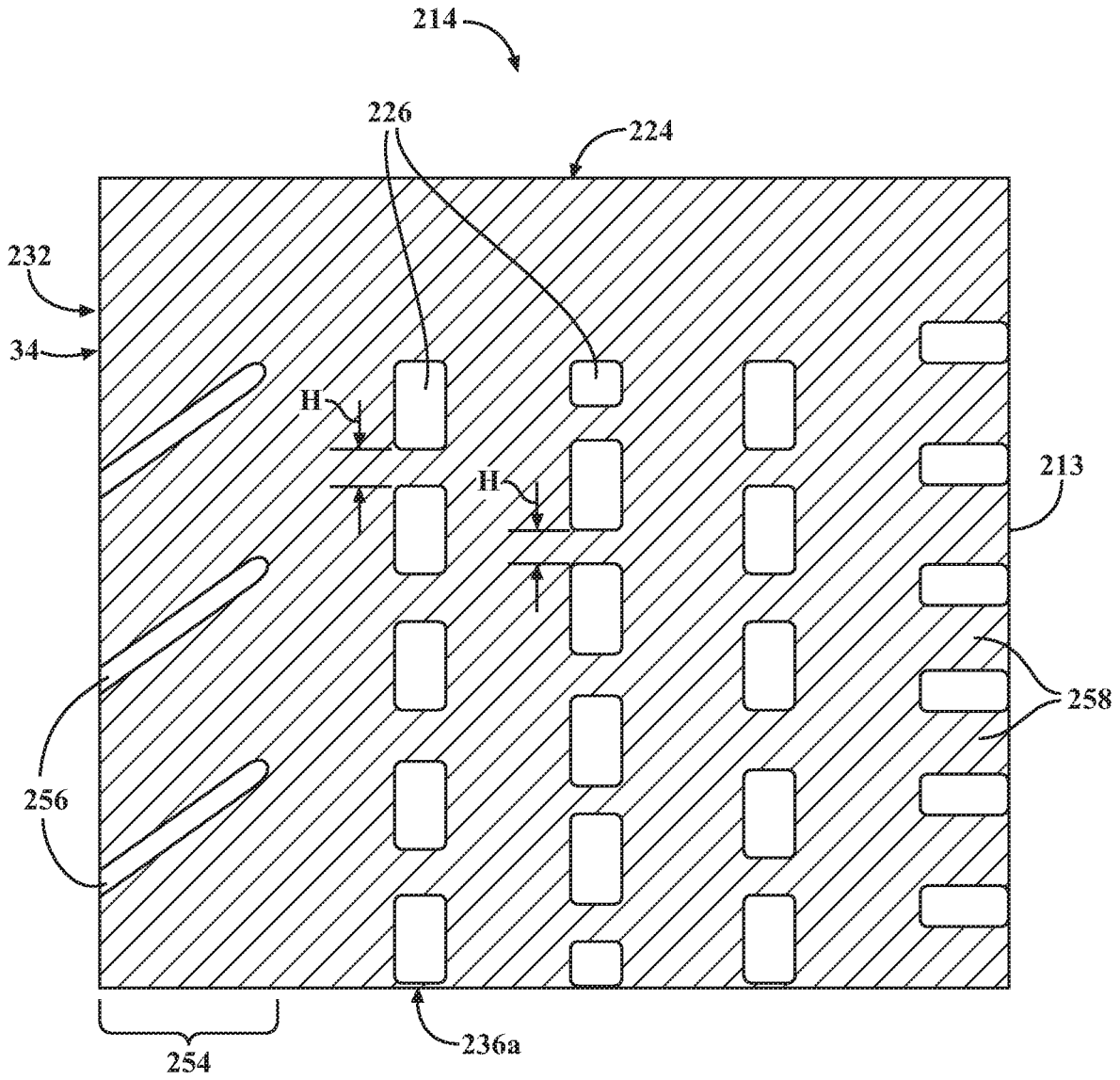
FIG. 4 PRIOR ART
FIG. 4 is an enlarged view similar to FIG. 3 illustrating a conventional core structure with a triple impingement trailing edge cooling configuration.

The low flow framing channels 34, 35 according to the present invention promote efficient usage of the cooling fluid $C_F$ to provide the required amount of cooling for the airfoil 11, while also preserving a sufficient amount of core material to ensure that the core structure possesses the strength necessary to survive casting and to prevent unzipping of the core structure. For comparison, FIG. 4 depicts a core structure for defining a conventional radially outer trailing edge cooling circuit (not shown) with triple impingement cooling, in which like reference numbers, increased by 100, are used to designate like or corresponding parts with respect to FIG. 3. As seen in FIG. 4, a radially outer cooling circuit section 214 comprises a conventional framing channel element 232, which utilizes a tie-bar and comprises a thicker, axially continuous portion of core structure at the radially outer edge 224 of the core structure. A downstream portion 213 of the core structure may define the trailing edge of an airfoil in a manner similar to that described for the trailing edge 13 of the airfoil 11 (see FIG. 1) and may comprise a plurality of trailing edge outlet-forming elements 258 for defining a plurality of trailing edge outlets (not shown).

The thicker portion of core structure at the radially outer edge 224 of the conventional radially outer cooling circuit section 214 shown in FIG. 4 provides the core strength necessary for the core structure to survive the casting process and to prevent unzipping of the core structure. The conventional framing channel (not shown) resulting from the conventional framing channel element 232 depicted in FIG. 4 provides a continuous, low resistance flowpath for cooling fluid directly from an entrance to the conventional trailing edge cooling circuit, as defined by a first column 236*a* of rib-forming apertures 226, toward the trailing edge outlets, as defined by the trailing edge outlet-forming apertures 258. For the conventional, triple impingement configuration shown in FIG. 4, the presence of the continuous, low resistance flowpath is generally acceptable. However, use of conventional framing channels in conjunction with highly efficient, multiple impingement cooling configurations that require the cooling fluid $C_F$ to follow a tortuous flowpath creates unacceptably high flow rates through the conventional framing channels, as a larger percentage of the cooling fluid flow is diverted to, and inefficiently ejected through, the lower resistance, conventional framing channels.

In contrast, the low flow framing channel elements 134 and resulting low flow framing channels 34, 35 according to the present invention reduce a cooling fluid flow rate to provide the required amount of cooling, while still preserving enough core material to prevent unzipping of the core structure. As seen in FIG. 3, the structure of the radially outer cooling circuit section 114 roughly corresponds to a configuration in which the proximal portions of alternating radially-aligned columns, i.e. second and fourth radially-aligned columns 136*b*, 136*d*, are shifted toward the radially outer edge 124 until the radially outermost rib-forming aperture 126 of each radially-aligned column 136*b*, 136*d* is continuous with the radially outer edge 124 to form the plurality of notches 140. As shown in FIGS. 2A, 2B, and 3 and as described herein, certain rib structures/rib-forming apertures 26, 26', 126 of certain axially-extending rows 38, 38', 138 are elongated in a radial direction, which helps to compensate for the presence of the protrusions/notches 40, 40', 140, i.e. to create an overlap in the axial direction. As described herein, this radial elongation and overlap ensures that the cooling fluid flow rate is sufficiently low and that the cooling fluid $C_F$ passing through the radially outer and radially inner low flow framing channels 34, 35 is used efficiently, i.e. the cooling fluid $C_F$ passing through the radially outer and inner low flow framing channels 34, 35 undergoes the same substantially 90 degree turns as the cooling fluid $C_F$ passing through the tortuous flowpath defined by the remainder of the radially outer and radially inner cooling circuits 14, 16.

In addition to producing a sufficiently low cooling fluid flow rate and promoting efficient usage of the cooling fluid $C_F$, the low flow channel elements 134 and resulting low flow framing channels 34, 35 must also provide enough core material to ensure structural stability during casting, particularly at the radially outer edge 124 of the radially outer cooling circuit section 114 and the radially inner edge of the radially inner cooling circuit section (not shown). With reference to FIGS. 2A and 3, these objectives may be achieved in the present invention by varying a radial spacing, i.e. a radial height of the axially-extending passages/passage elements 28, 128, between the rib structures/rib-forming apertures 26, 126 within each radially-aligned column 36, 136.

With specific reference to the radially outer cooling circuit section 114 in FIG. 3, the first axially-extending passage elements 148*a*, 148*b* within the radially outer low flow framing channel element 134 comprise a radial height $H_1$, and the second axially-extending passage elements 150 comprise a radial height $H_2$. A prevalent radial height H, also referred to herein as a nominal height, is shown with respect to third axially-extending passage elements 152. The nominal or prevalent radial height H may be defined as a minimum height of the axially-extending passage elements 128 that may be used to define the axially-extending passages 28 present in the radially outer and radially inner cooling circuits 14, 16 shown in FIGS. 2A and 2B. The remaining axially-extending passage elements 128 located radially inwardly of the third axially-extending passage elements 152 may also comprise the prevalent radial height H. In particular aspects of the invention, $H_1$ may be greater than H as shown in FIG. 3. In some aspects, $H_2$ may be greater than H. In certain aspects of the invention, $H_1$ may be greater than or equal to $H_2$, and in a particular aspect, $H_1>H_2>H$. In further aspects, $H_1$ may be less than $H_2$. In additional aspects of the invention, an axial width W of the plurality of radially-extending channel elements 130 may be substantially uniform.

With continued reference to FIG. 3, by way of a particular example, radial heights $H_1$, $H_2$, and H may comprise a ratio, relative to each other, of approximately 3-2-1, in which $H_1$ is approximately three times the prevalent radial height H and $H_2$ is approximately two times the prevalent radial height H. The radially-extending columns 136 that are not aligned with the notches 140, such as a third radially aligned column 136*c* shown in FIG. 3, may comprise a ratio of approximately 3-2-1 because a thickest portion of the core ($H_1$ or "3"), i.e. the first axially-extending passage element 148*a*, is defined between the radially outer edge 124 of the radially outer cooling circuit section 114 and the proximal portion 142 of the rib-forming apertures 126 of the first axially-aligned row 138*a*. The second axially-extending passage element 150 of the third radially aligned column 136*c* comprises a less thick portion of the core ($H_2$ or "2"), while the third axially-extending passage element 152 comprises the prevalent radial height H ("1").

Continuing with the specific example, it can be seen in FIG. 3 that the radially-aligned columns 136 that align with the notches 140, such as the second axially-aligned column 136*b*, may comprise a ratio of approximately 0-3-2-1 because the notches 140 extend radially inwardly from the radially outer edge 124 such that there is no portion of the core located radially outwardly from the notches 140 ("0"). The first axially-extending passage element 148*b* of the second axially-aligned column 136*b*, which is defined between the distal portion 144*a* of the notch 140 and the proximal portion 142 of the rib-forming apertures 126 of the first axially-aligned row 138*a*, comprises a thick portion of the core ($H_1$ or "3"), while the second axially-extending passage element 150 comprises a less thick portion of the core ($H_2$ or "2") and the third axially-extending passage element 152 comprises the prevalent radial height H ("1"). Thus, as seen in FIG. 3, adjacent, radially-extending columns 136 of rib-forming apertures 126 may comprise an alternating radial spacing pattern of approximately 3-2-1 and 0-3-2-1, as herein described.

In certain aspects of the invention, an amount of axial overlap between the distal portion of the notches 140 and the proximal portion 142 of the rib-forming apertures 126 of the first axially-aligned outer row 138*a* may be greater than or equal to about 25% of $H_1$. In further aspects of the invention, an amount of axial overlap between the proximal portion 142 of each rib-forming aperture 126 and the distal portion 144 of the rib-forming apertures 126 in adjacent, radially-aligned columns 136 may also be greater than or equal to about 25% of $H_1$.

While these features regarding radial height and axial width are described with respect to the radially outer cooling circuit section 114 as shown in FIG. 3, those skilled in the art will understand that these features may apply equally to the structure of the radially inner cooling circuit section as herein described. In addition, although described in detail with respect to the core structure, those skilled in the art will understand that these features of the invention regarding radial height and axial width may also apply to the corresponding radial heights $H_1$, $H_2$, and H of the first axially-extending passages 48*a*, 48*b*, the second axially-extending passages 50, and the third axially-extending passages 52, respectively (not labeled in FIG. 2B), and the corresponding axial width of the plurality of radially-extending channels 30 of the radially outer and inner cooling circuits 14, 16 of the airfoil 11, as shown in FIGS. 1, 2A, and 2B and as described herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A core structure for casting a gas turbine engine airfoil, the core structure comprising a trailing edge section for defining a trailing edge of the gas turbine engine airfoil, wherein an axial direction is defined between a leading edge and the trailing edge of the gas turbine engine airfoil, at least a portion of the trailing edge section comprising:

a plurality of rib-forming apertures defined by a plurality of radially-extending channel elements and axially-extending passage elements, wherein the rib-forming apertures are arranged in radially-aligned columns, the rib-forming apertures of alternating radially-aligned columns forming axially-aligned rows; and a radially outer framing channel element located adjacent to a radially outer edge of the trailing edge section, wherein the radially outer framing channel element comprises a plurality of notches extending radially inwardly from the radially outer edge;

wherein the rib-forming apertures comprising a first axially-aligned outer row are elongated in a radial direction such that a distal portion of the notches overlaps in the axial direction with a proximal portion of the rib-forming apertures comprising the first axially-aligned outer row;

wherein the rib-forming apertures comprise a second axially-aligned outer row located radially inward of the first axially-aligned outer row, wherein the notches are radially aligned with the rib-forming apertures of the second axially-aligned outer row;

wherein the rib-forming apertures comprise a third axially-aligned outer row located radially inward of the second axially-aligned outer row, wherein the rib-forming apertures comprise a remaining axially-aligned outer row located radially inward of the third axially-aligned outer row, wherein the rib-forming apertures comprising the first axially-aligned outer row, the third axially-aligned outer row and the remaining axially-aligned outer row form the alternating radially-aligned columns, wherein a radial height of a first axially-extending passage element and a radial height of a second axially-extending passage element are greater than a minimal radial height of the axially-extending passage elements within the core structure, wherein the radial height of the first axially-extending passage element is defined between the radially outer edge and a proximal end of the rib-forming apertures comprising the first axially-aligned outer row, wherein the radial height of the second axially-extending passage element is defined between a distal end of the rib-forming apertures comprising the first axially-aligned outer row and a proximal end of the rib-forming apertures comprising the third axially-aligned outer row, and wherein the minimal radial height of the axially-extending passage elements is defined between a distal end of the rib-forming apertures comprising the third axially-aligned outer row and a proximal end of the rib-forming apertures comprising the remaining axially-aligned outer row.

2. The core structure of claim 1, wherein the rib-forming apertures comprising the third axially-aligned outer row are elongated in the radial direction such that the rib-forming apertures comprising the second axially-aligned outer row overlap in the axial direction with the rib-forming apertures comprising the third axially-aligned outer row.

3. The core structure of claim 1, wherein a portion of the radially outer edge between the notches comprises a substantially planar area.

4. The core structure of claim 1, wherein the trailing edge section further comprises a radially inner framing channel element located adjacent to a radially inner edge of the trailing edge section, wherein the radially inner framing channel element comprises a further plurality of notches extending radially outwardly from the radially inner edge;

wherein a first axially-aligned inner row of the rib-forming apertures is elongated in the radial direction such that a distal portion of the further plurality of notches overlaps in the axial direction with the rib-forming apertures comprising the first axially-aligned inner row; and wherein the further plurality of notches are radially aligned with the rib-forming apertures of a second axially-aligned inner row of the rib-forming apertures.

5. The core structure of claim 4, wherein a portion of the radially inner edge between the further plurality of notches comprises a substantially planar area.

6. An airfoil in a gas turbine engine comprising:

an outer wall defining a leading edge, a trailing edge, a pressure side, a suction side, a radially inner end, and a radially outer tip comprising a tip cap, wherein an axial direction is defined between the leading edge and the trailing edge;

a trailing edge cooling circuit defined in a portion of the outer wall adjacent to the trailing edge and receiving cooling fluid for cooling the outer wall, the trailing edge cooling circuit comprising:

a plurality of axially-extending passages and a plurality of radially-extending channels defined by a plurality of rib structures, wherein the rib structures are arranged in radially-aligned columns that are substantially transverse to a flow axis of the cooling fluid, the rib structures of alternating radially-aligned columns forming axially-aligned rows; and a radially outer framing channel located adjacent to the tip cap and comprising a plurality of protrusions extending radially inwardly from the tip cap;

wherein the rib structures comprising a first axially-aligned outer row are elongated in a radial direction such that a distal portion of the protrusions overlaps in the axial direction with a proximal portion of the rib structures comprising the first axially-aligned outer row;

wherein the rib structures comprise a second axially-aligned outer row located radially inward of the first axially-aligned outer row, wherein the protrusions are radially aligned with the rib structures of the second axially-aligned outer row;

wherein the rib structures comprise a third axially-aligned outer row located radially inward of the second axially-aligned outer row, wherein the rib structures comprise a remaining axially-aligned outer row located radially inward of the third axially-aligned outer row, wherein the rib structures comprising the first axially-aligned outer row, the third axially-aligned outer row, and the remaining axially-aligned outer row form the alternating radially-aligned columns, wherein the protrusions are substantially transverse to a flow axis of the cooling fluid;

wherein a radial height of a first axially-extending passage and a radial height of a second axially-extending passage are greater than a minimal radial height of the axially-extending passages in the trailing edge cooling circuit, wherein the radial height of the first axially-extending passage is defined between the tip cap and a proximal end of the rib structures comprising the first axially-aligned outer row, wherein the radial height of the second axially-extending passage is defined between a distal end of the rib structures comprising the first axially-aligned outer row and a proximal end of the rib structures comprising the third axially-aligned outer row, and wherein the minimal radial height of the axially-extending passages is defined between a distal end of the rib structures comprising the third axially-aligned outer row and a proximal end of the rib structures comprising the remaining axially-aligned outer row.

7. The airfoil of claim 6, wherein the rib structures comprising the third axially-aligned outer row are elongated in the radial direction such that the rib structures comprising the second axially-aligned outer row overlap in the axial direction with the rib structures comprising the third axially-aligned outer row.

8. The airfoil of claim 6, wherein the plurality of rib structures and the plurality of protrusions define a flowpath in the axial direction through the radially outer framing channel that requires the cooling fluid to make a plurality of 90 degree turns.

9. The airfoil of claim 6, wherein the trailing edge cooling circuit further comprises a radially inner framing channel located adjacent to the radially inner end and comprising a further plurality of protrusions extending radially outwardly from the radially inner edge;

wherein the rib structures comprising a first axially-aligned inner row are elongated in the radial direction such that a distal portion of the further plurality of protrusions overlaps in the axial direction with the rib structures comprising the first axially-aligned inner row;

wherein the rib structures comprising a third axially-aligned inner row are elongated in the radial direction such that the rib structures comprising a second axially-aligned inner row overlap in the axial direction with the rib structures comprising the third axially-aligned inner row;

wherein the further plurality of protrusions are radially aligned with the rib structures comprising the second axially-aligned inner row; and wherein the further plurality of protrusions are substantially transverse to the flow axis of the cooling fluid.

10. The airfoil of claim 9, wherein the plurality of rib structures and the further plurality of protrusions define a flowpath in the axial direction through the radially inner framing channel that requires the cooling fluid to make a plurality of 90 degree turns.

* * * * *